US007794104B2

(12) United States Patent
Wu

(10) Patent No.: US 7,794,104 B2
(45) Date of Patent: Sep. 14, 2010

(54) MULTI-FUNCTIONED FLASHLIGHT FOR VEHICLE RESCUE USE

(76) Inventor: Jianjun Wu, No. 87-6, West ShuangBu Road, Ouhai Economic Development Zone, WenZhou, Zhejiang (CN)

( * ) Notice: Subject to any disclaimer, the term of this patent is extended or adjusted under 35 U.S.C. 154(b) by 271 days.

(21) Appl. No.: 12/110,328

(22) Filed: Apr. 27, 2008

(65) Prior Publication Data

US 2008/0278938 A1 Nov. 13, 2008

(30) Foreign Application Priority Data

May 9, 2007 (CN) ..... 2007 2 0037635

(51) Int. Cl.
*F21L 13/00* (2006.01)

(52) U.S. Cl. ..... 362/192; 362/184; 362/208

(58) Field of Classification Search ..... 362/109, 362/119, 183, 184, 192–195, 200, 202, 206, 362/208, 253; 320/107, 114, 123; 310/83, 310/75 B, 75 R See application file for complete search history.

(56) References Cited

U.S. PATENT DOCUMENTS 1,429,601 A * 9/1922 Luzy ..... 310/75 B
1,507,768 A * 9/1924 Collins ..... 362/192
1,624,686 A * 4/1927 Smith ..... 362/192
1,775,166 A * 9/1930 Johnson ..... 362/192
2,277,897 A * 3/1942 Alexander ..... 362/192
2,490,309 A * 12/1949 Lehman ..... 362/192
3,099,402 A * 7/1963 Speck ..... 362/192
4,360,860 A * 11/1982 Johnson et al. ..... 362/192
4,701,835 A * 10/1987 Campagnuolo et al. ..... 362/192
5,839,817 A * 11/1998 Wei ..... 362/192
6,914,340 B2 * 7/2005 Becker et al. ..... 290/1 R
6,959,999 B2 * 11/2005 Lee ..... 362/192
7,077,540 B2 * 7/2006 Yen ..... 362/183
7,090,372 B2 * 8/2006 Liao et al. ..... 362/192
7,222,984 B2 * 5/2007 Lee ..... 362/192
2004/0051503 A1 * 3/2004 Fan ..... 320/117
2004/0120143 A1 * 6/2004 Chen ..... 362/192

* cited by examiner

*Primary Examiner*—Hargobind S Sawhney
(74) *Attorney, Agent, or Firm*—Banger Shia

(57) ABSTRACT

A multi-functioned flashlight for vehicle rescue use is comprised of a cylinder body with lighting components installed inside its cylinder head, whereof its cylinder head is externally installed with a protruded knocking cone piece and a dismountable cone cover. Its cylinder body is installed with a flash bulb and its flash circuit internally and a flash transparent piece externally. The tail part of the cylinder body is installed with a guard piece with a blade installed in-between with its cutting edge facing outwards. Thereof, it is characterized in that a micro-generator and its gear transmission set are installed inside the cylinder body; the output ends of the micro-generator are electrically connected with the charging circuit and its charging batteries; and the cylinder body is externally installed with a swing arm whose rotating head is through the mounting hole on the cylinder body to engage with the gear transmission set.

12 Claims, 4 Drawing Sheets

A-A

MULTI-FUNCTIONED FLASHLIGHT FOR VEHICLE RESCUE USE

BACKGROUND OF THE INVENTION (a) Field of the Invention

The invention is related to a kind of flashlight, especially to a multi-functioned flashlight for vehicle rescue use.

(b) Description of the Prior Art

In case of emergency, the vehicle driver may has to break the window to get out, wherein without a tool, he may get hurt by hitting the window directly, and he also will need a tool to cut the safety belt in hasty way if it can not be released. Further, he also needs a sound and flashlight alarming device in order to attract attentions of the nearby people to come for rescue in time. The flashlight is a necessary tool for vehicle drivers and is usually prepared in the driving chamber for easy access. However, most flashlights have only a single function which is not enough to meet different requirements in various circumstances. Therefore, the applicant has once designed a vehicle use sound and light alarming rescue flashlight, publication number: CN2739484Y to solve the above said problems. Nonetheless, as the said type of flashlights is required to carry batteries, there always remains an uncertainty of the work life of batteries, such as when it will be out of electricity or how long it can last in usage, etc. Such uncertainty sometimes will bring lethal danger to the drivers and the problems of yearning for outside rescue but incapable of self-rescue will continue to exist.

SUMMARY OF THE INVENTION

The new type embodiment of the invention is to overcome the inadequacy of the existing art and to disclose a multi-functioned flashlight for vehicle rescue use with diversified functions while satisfying the needs of the vehicle driver in emergency use.

The new type multi-functioned flashlight for vehicle rescue use of the invention still includes the cylinder body and the lighting components installed inside its cylinder head, whereof the external periphery of the cylinder head is installed with a protruded knocking cone piece and a dismountable cone cover. A flash bulb and its flash circuit are installed inside the said cylinder body and a flash transparent piece is installed on the cylinder body's external surface correspondingly. The tail part of the cylinder body is suspendedly installed with a guard piece which matches the outlook of the cylinder body, and a blade is installed in the space between the said guard piece and the cylinder body surface with its cutting edge facing outwards. Thereof, it is characterized in that a micro-generator and its gear transmission set are installed inside the cylinder body; the output ends of the micro-generator are electrically connected with the charging circuit and its charging batteries; and the exterior of the cylinder body is installed with a swing arm, whereby the rotating head of the said swing arm is through the mounting hole on the cylinder body to engage with the gear transmission set.

Thereof, the sound circuit and connected speaker can be installed as needed in the cylinder body. The lighting components in the cylinder head can be constituted by light source components such as LEDs.

The new type multi-functioned flashlight for vehicle emergency rescue use of the invention can manually charged for use, thereby it greatly enhanced the practical usefulness of the flashlight and is able to meet the usage requirements of the vehicle driver in various emergency circumstances.

The new type invention is further described below with the following Figs. and embodying examples.

DETAILED DESCRIPTION OF THE PREFERRED EMBODIMENTS

Figure 1:
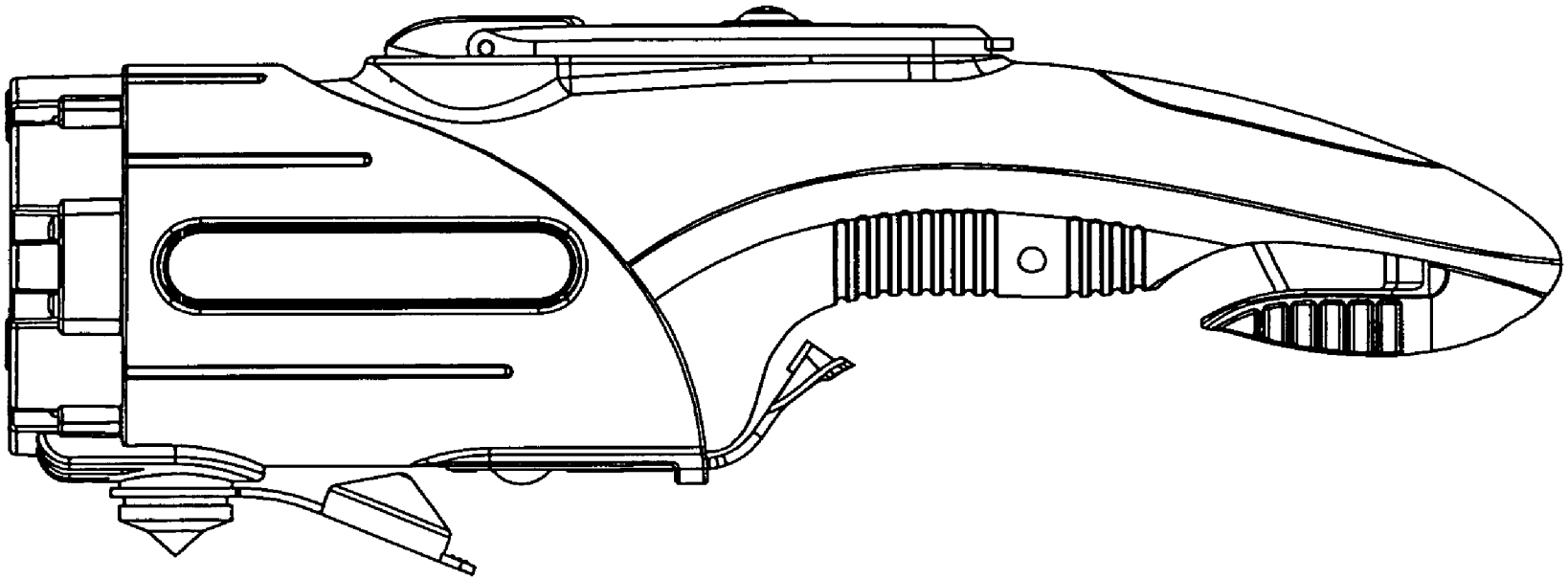
FIG. 1 is an outlook structural schematic diagram of the new type embodiment of the invention.
Figure 2:
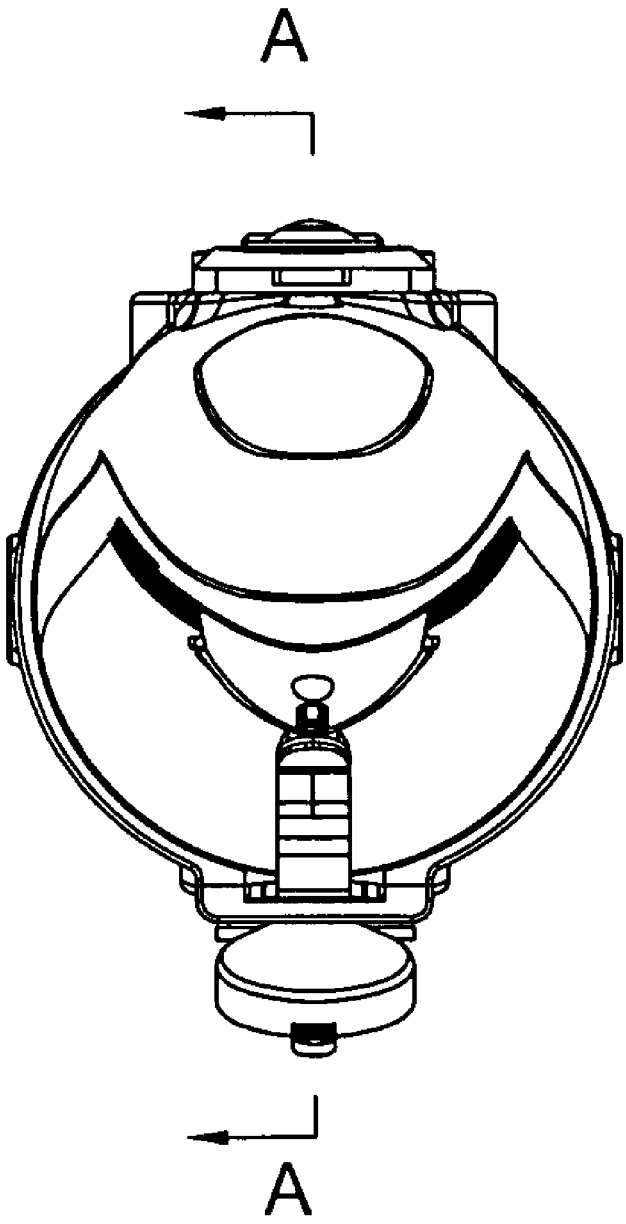
FIG. 2 is a left side view of FIG. 1.
Figure 3:
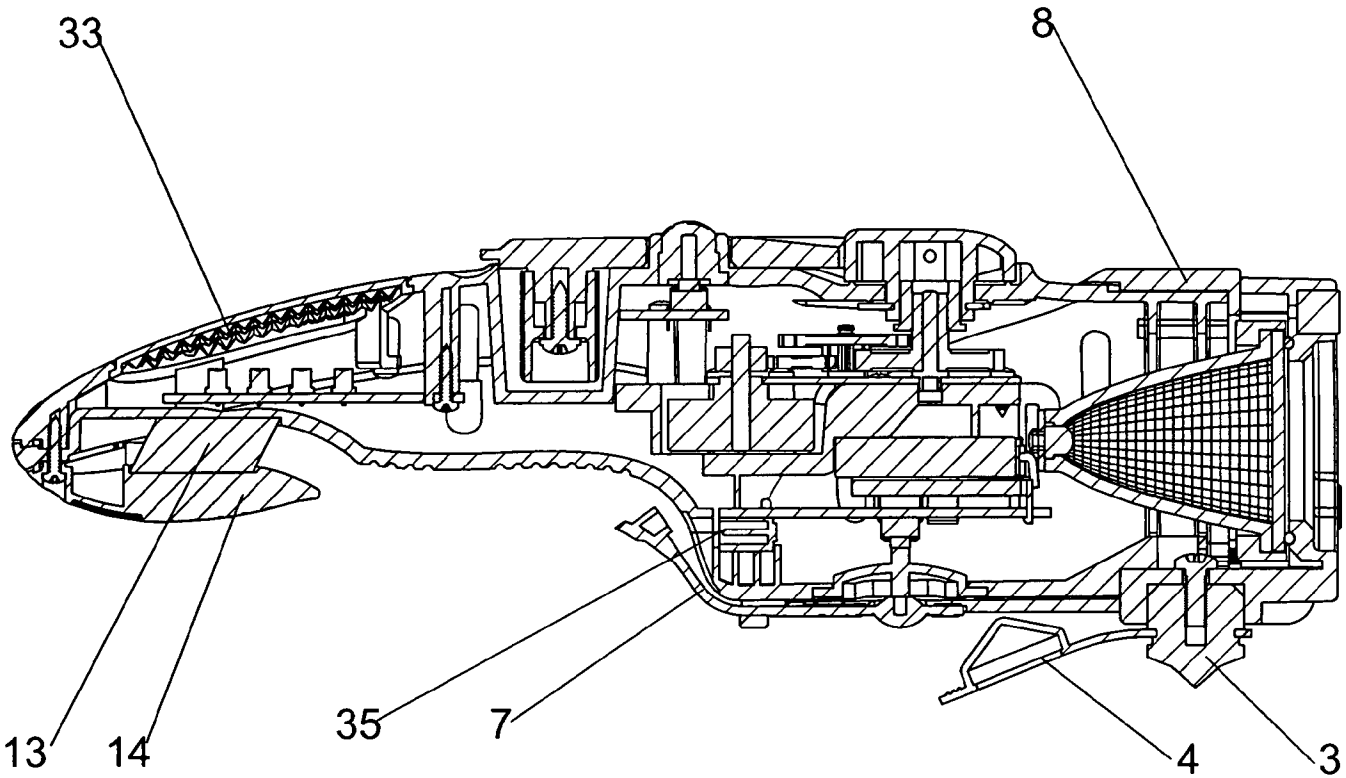
FIG. 3 is a A-A cross-section view of FIG. 2.
Figure 4:
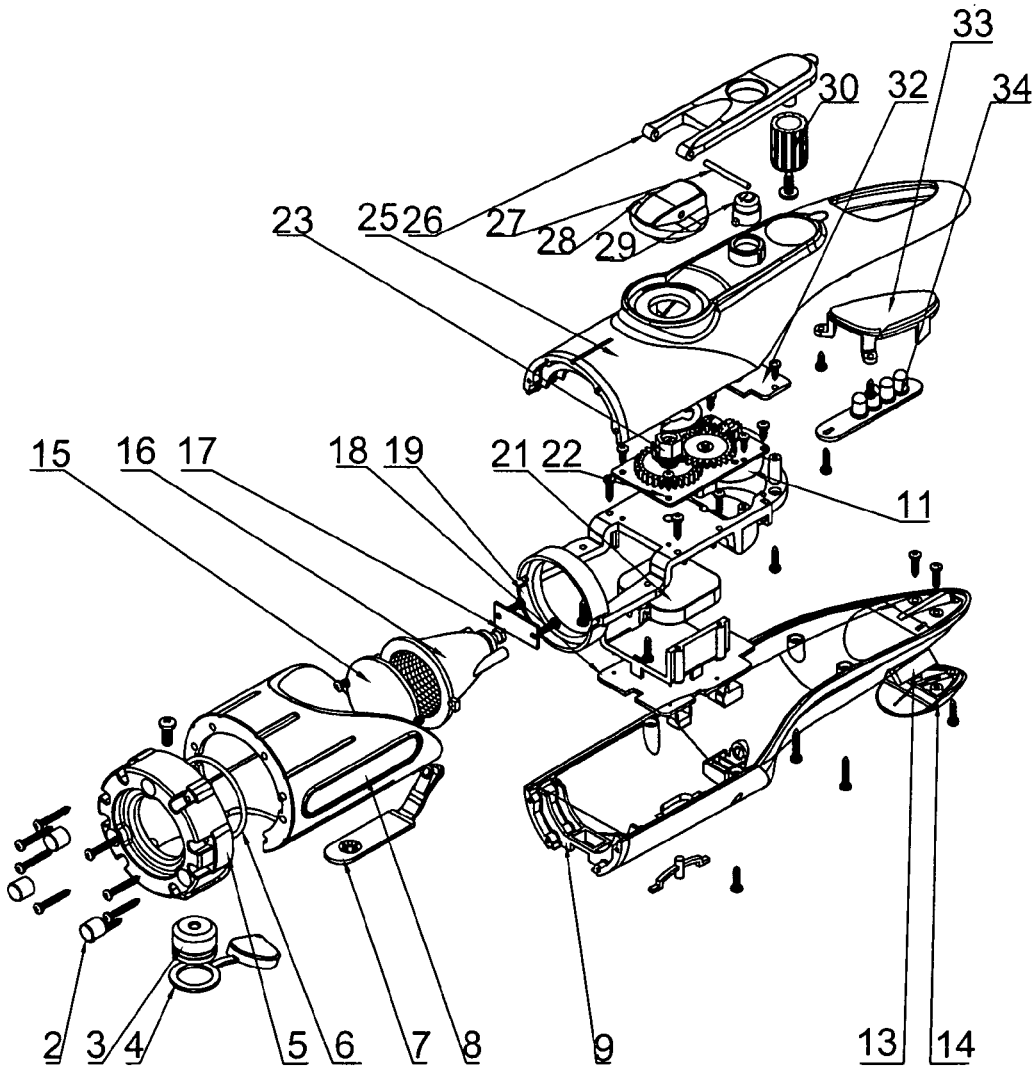
FIG. 4 is a 3D explosion view of the new type embodiment of the invention.

As shown in the FIG. 1, the new type embodiment is comprised of a head cover 5, cylinder sleeve 8 and upper and lower cylinder bodies 25, 9. The cylinder body is split into several parts for easy assembly and layout, in which the head cover 5 is connected with the cylinder sleeve 8, and the said cylinder sleeve 8 is connected with the upper and lower cylinder bodies 25, 9. The cylinder head in the embodying example is referred to head cover 5 and cylinder sleeve 8. The external periphery of the cylinder head is firmly installed with a knocking cone piece 3 which is especially installed on the head cover 5, the knocking cone piece 3 can be used to break the vehicle window. The said knocking cone piece 3 is provided with a cone cover 4 to cover the cone piece when it is not used. Further, the head cover 5 is firmly installed with magnets 2 for attaching the cylinder body to a particular location such as that if the flash light can be absorbed on top of the vehicle, the other warning functions of the flashlight can exploited more obviously. The lighting components are installed inside the cylinder head, whereof the said lighting components in this embodying example include a spotlight cup 16, lighting circuit component 17 and lens 15, etc. Semiconduction type lighting tube is used in this embodying example due to its power saving, and several LEDs can be used simultaneously in general to obtain better lighting effect; whereof, of course, an ordinary light bulb can also be used in this new type embodiment. The tail part of the cylinder body in the embodying example is referred to the tail part of the lower cylinder body 25 which is suspendedly installed with a guard piece 14 which matches the outlook of the cylinder body, i.e. the lower cylinder body 25, whereof a blade 13 is installed in the space between the said guard piece 14 and the cylinder body surface with its cutting edge facing outwards, whereof the said blade 13 can be used to cut off safety belts or other ropes. A micro-generator 11 and its gear transmission set 22 are installed inside the cylinder body. In this embodying example, a micro-generator 11 and its gear transmission set 22 are installed inside the cylinder body constituted by the upper and lower cylinder bodies 25, 9. Correspondingly, a frame 19 is installed inside the cylinder body constituted by the upper and lower cylinder bodies 25, 9. Further in this embodying example, a flash bulb and its flash circuit 34 are also installed inside the said cylinder body constituted by the upper and lower cylinder bodies 25, 9. A flash transparent piece 33 is also installed on the cylinder body's external surface correspondingly, thereby the flashlight can also be used as flash warning device for alerting other people's attention Further, the sound circuit and connected speaker can be installed as needed in the cylinder body of the embodying example. In actual application, the sound circuit and speaker can send alarms to ask for help. The output ends of the micro-generator 11 are electrically connected with its charging circuit and its charging batteries 21, whereof the charging circuit, etc. can be designed to put on the main circuit board 18. In the embodying example, the exterior of the cylinder body 25 is installed with a swing arm 26, the rotating head 28 of the said swing arm is through the mounting hole on the cylinder body 25 to engage with the micro-generator 11 of the gear transmission set 22, and a rotating head connector spindle 23 is usually provided between the gear transmission set 22 and the rotating head 28. The rotating head 28 of the swing arm 26 is further firmly fixed in mounting hole on the cylinder body for matching the rotation in the embodying example; a rotation pin 27 is installed between the swing arm 26 and its rotating head 28 to allow swing arm 26 to coordinate with its corresponding rotating head 28 for rotation, and the external surface of the cylinder body is provided with a cavity for housing the swing arm 26 and the swing arm handle 30. A pushbutton seat is provided at the junction between the swing arm 26 and the cylinder body, wherein the said cylinder body is referred to the upper cylinder body 25 in the embodying example. The swing arm 26 is correspondingly installed with a pushbutton hole, the pushbutton 29 installed on the said pushbutton seat can be used for lighting control or other function controls such as the flash warning control attached at the rear end, etc. The pushbutton 29 is correspondingly installed with a switching circuit 32 and the external surface of the cylinder body is installed with a charger seat 35 which is electrically connected with the output ends of the charging circuit. The installation of the said charger seat 35 further expands user functions of the flashlight to function as a power charger. A charger cover 7 is provided at the place of the charger seat 35 to give a good waterproof effect, while waterproof at other parts are usually done by adding sealing rings 6, etc that are not specifically described herein.

I claim:

1. A multi-functioned flashlight for vehicle rescue use which is comprised of a cylinder body with lighting components installed inside its cylinder head, whereof the external periphery of the cylinder head is installed with a protruded knocking cone piece and a dismountable cone cover; a flash bulb and its flash circuit are installed inside the said cylinder body and a flash transparent piece is also installed on the cylinder body's external surface correspondingly; the tail part of the cylinder body is suspendedly installed with a guard piece which matches the outlook of the cylinder body, and a blade is installed in the space between the said guard piece and the cylinder body surface with its cutting edge facing outwards; thereof, it is characterized in that a micro-generator and its gear transmission set are installed inside the cylinder body; the output ends of the micro-generator are electrically connected with the charging circuit and its charging batteries; and the exterior of the cylinder body is installed with a swing arm, whereby the rotating head of the said swing arm is through the mounting hole on the cylinder body to engage with the gear transmission set.

2. The multi-functioned flashlight for vehicle rescue use as in claim 1, which is characterized in that the rotating head of the swing arm is further firmly fixed in mounting hole on the cylinder body for matching the rotation; a rotation pin is installed between the swing arm and its rotating head to allow the swing arm to coordinate with its corresponding rotating head for rotation, and the external surface of the cylinder body is provided with a cavity for housing the swing arm and the swing arm handle.

3. The multi-functioned flashlight for vehicle rescue use as in claim 2, which is characterized in that: A pushbutton seat is provided at the junction between the swing arm and the cylinder body, and the swing arm is correspondingly installed with a pushbutton hole.

4. The multi-functioned flashlight for vehicle rescue use as in claim 3, which is characterized in that: the external surface of the cylinder body is installed with a charger seat which is electrically connected with the output ends of the charging circuit.

5. The multi-functioned flashlight for vehicle rescue use as in claim 4, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

6. The multi-functioned flashlight for vehicle rescue use as in claim 3, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

7. The multi-functioned flashlight for vehicle rescue use as in claim 2, which is characterized in that: the external surface of the cylinder body is installed with a charger seat which is electrically connected with the output ends of the charging circuit.

8. The multi-functioned flashlight for vehicle rescue use as in claim 7, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

9. The multi-functioned flashlight for vehicle rescue use as in claim 2, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

10. The multi-functioned flashlight for vehicle rescue use as in claim 1, which is characterized in that: the external surface of the cylinder body is installed with a charger seat which is electrically connected with the output ends of the charging circuit.

11. The multi-functioned flashlight for vehicle rescue use as in claim 10, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

12. The multi-functioned flashlight for vehicle rescue use as in claim 1, which is characterized in that: the cylinder body is comprised of the head cover, the cylinder sleeve as well as the upper and lower cylinder bodies, whereof the head cover is connected with the cylinder sleeve, and the said cylinder sleeve is connected with the upper and lower cylinder bodies; the lighting components are installed inside the cylinder head which is constituted by the head cover and the cylinder sleeve; a micro-generator and its gear transmission set are installed inside the cylinder body which is constituted by the upper and lower cylinder bodies.

* * * * *